US009138109B1

(12) United States Patent
Leon

(10) Patent No.: US 9,138,109 B1
(45) Date of Patent: Sep. 22, 2015

(54) UNIVERSAL AUTOMATED HANDS-FREE LIQUID DISPENSER PUMP

(71) Applicant: ORANGE ROCK CONSULTING LLC, Glendale, CA (US)

(72) Inventor: John Leon, Anaheim Hills, CA (US)

(73) Assignee: Orange Rock Consulting LLC, Glendale, CA (US)

( * ) Notice: Subject to any disclaimer, the term of this patent is extended or adjusted under 35 U.S.C. 154(b) by 0 days.

(21) Appl. No.: 14/336,396

(22) Filed: Jul. 21, 2014

Related U.S. Application Data

(60) Provisional application No. 61/858,903, filed on Jul. 26, 2013.

(51) Int. Cl.
*B67D 7/78* (2010.01)
*A47K 5/12* (2006.01)

(52) U.S. Cl.
CPC ..... *A47K 5/1217* (2013.01)

(58) Field of Classification Search
CPC .. A47K 5/1217; B05B 9/0861; B67D 1/0802; B67D 2001/0824; B67D 2001/0825; B67D 3/0064
USPC ..... 222/63, 385, 464.1, 464.3, 464.5, 562
See application file for complete search history.

(56) References Cited

U.S. PATENT DOCUMENTS

| | | | | | |
|---|---|---|---|---|---|
| 1,657,013 | A * | 1/1928 | Kettle | 285/139.3 |
| 1,977,328 | A * | 10/1934 | Sousley | 215/5 |
| 4,915,347 | A * | 4/1990 | Iqbal et al. | 251/30.03 |
| 4,938,384 | A * | 7/1990 | Pilolla et al. | 222/52 |
| 4,967,935 | A * | 11/1990 | Celest | 222/52 |
| 2002/0070249 | A1 * | 6/2002 | Gheorgheos | 222/505 |
| 2003/0089744 | A1 * | 5/2003 | Mandile | 222/464.3 |
| 2011/0278322 | A1 * | 11/2011 | Reynolds et al. | 222/1 |
| 2013/0264355 | A1 * | 10/2013 | Jodoin | 222/63 |

* cited by examiner

*Primary Examiner* — Patrick M Buechner
(74) *Attorney, Agent, or Firm* — Plager Schack LLP

(57) ABSTRACT

A universal automated hands-free liquid dispensing system is provided that includes an expandable tube to fit different liquid containers, a pump to draw liquid out of the container and through the tube, and a sensor for detecting the presence of a user so that the user can receive liquid from the container without the need to touch the dispensing system. In some embodiments, a universal dispenser cap is also provided to fit over dispensers of varied neck and spout configurations and dimensions.

7 Claims, 7 Drawing Sheets

UNIVERSAL AUTOMATED HANDS-FREE LIQUID DISPENSER PUMP

CORRESPONDING APPLICATION

The present application takes priority from provisional application Ser. No. 61/858,903 filed Jul. 26, 2013, the entire contents of which are incorporated herein in its entirety by reference.

BACKGROUND

The present invention related to automated liquid dispensers, and in particular dispensers that are configured to adapt to liquid containers of different sizes. For example, FIGS. 1A and 1B show a generic liquid container, which in one case may be a bottle 1 with a cap 2 in which the throat of the bottle is threaded 3 and the cap is configured with mating threads 4 to be secured to the top of the container. Embodiments of the present invention may be used with liquid containers such as that shown in FIGS. 1A and 1B.

BRIEF DESCRIPTION OF THE FIGURES

The detailed description of some embodiments of the invention will be made below with reference to the accompanying figures, wherein like numerals represent corresponding parts of the figures.

DETAILED DESCRIPTION OF CERTAIN EMBODIMENTS

Figure 1A:
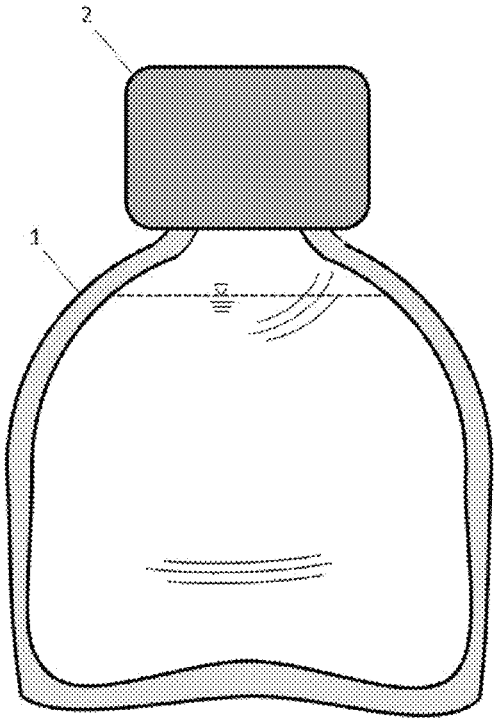
FIGS. 1A and 1B show schematic elevational views, with FIG. 1B being in cross-section, of a container for containing liquids therein, which is one application for embodiments of the present invention described herein.
Figure 1B:
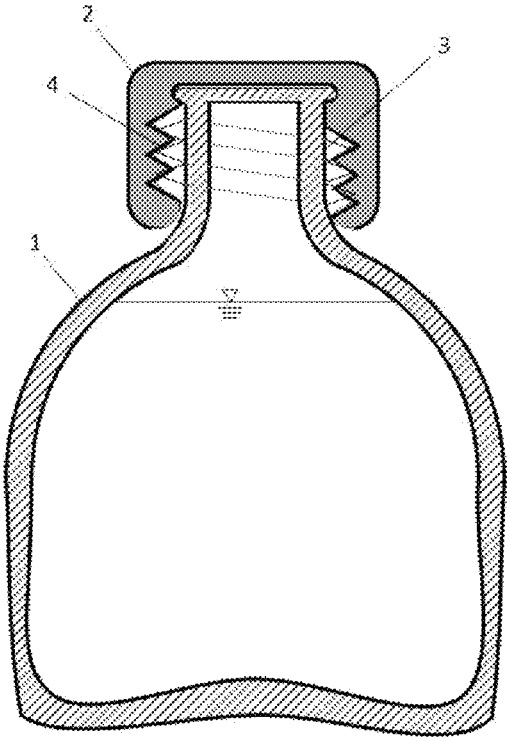
Figure 2:
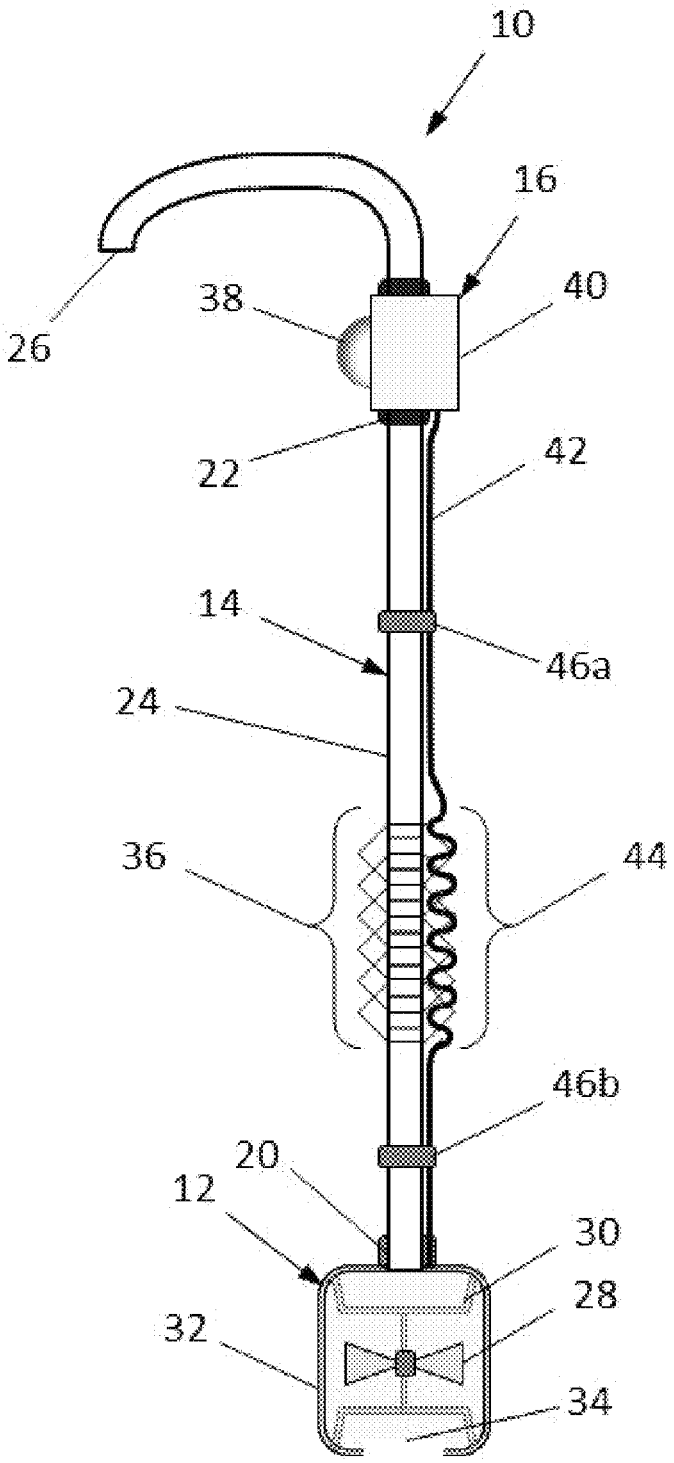
FIG. 2 shows a schematic elevational view of one embodiment of the present invention, with only the bottom portion 12 shown in cross-section.

By way of example, and referring to FIG. 2, one embodiment of the present automated liquid dispenser system 10 comprises means 12 for pumping liquid from within a container through a fluid delivery assembly 14 where the pumping means 12 is controlled by a controller assembly 16 mounted on the fluid delivery assembly 14. In one embodiment, the pumping means 12 is connected to the fluid delivery assembly via a first connector 20, while the controller assembly 16 is connected to the fluid delivery assembly via a second connector 22. Both connectors are secured to a tube 24 with a spout an outlet 26 that are part of the fluid delivery assembly 14.

The pumping means 12 may comprise an impeller 28 or other means for pumping fluid by adding positive energy to the fluid, in which the impeller is supported by a bracket 30 within a housing 32 comprising an opening 34 into which the fluid may be drawn and pumped into the fluid delivery assembly 14.

Figure 3:
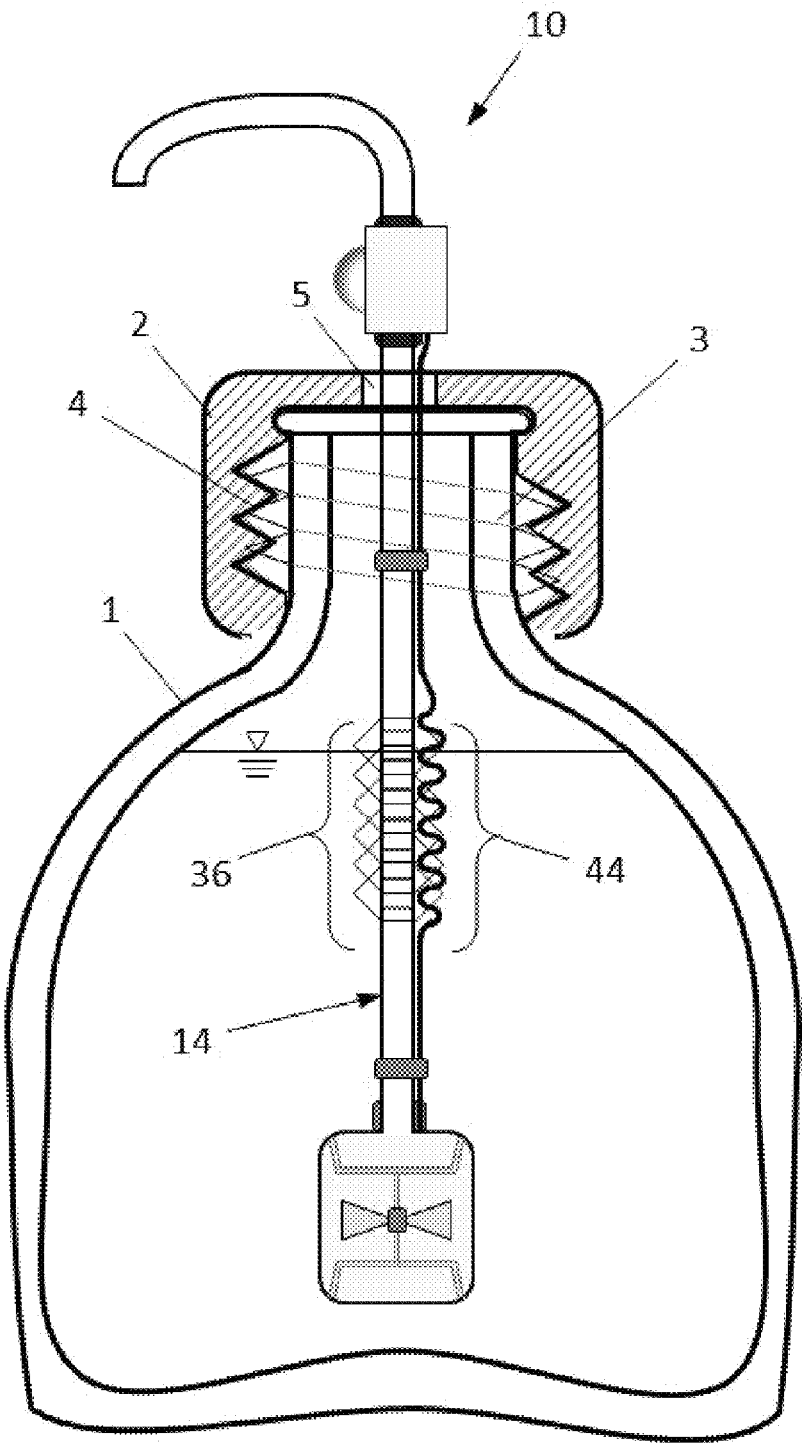
FIG. 3 shows a schematic elevational view of one application of the embodiment of FIG. 2.

Referring to FIG. 3, one example embodiment 10 of the automated dispensing system is shown in the container 1 with cap 2, in which an aperture 5 has been provided in the cap 2 to accommodate the dispensing system (i.e., where the tube 24 of the fluid delivery assembly 14 may extend through the cap aperture 5. With some liquid containers, a cap is already provided with an aperture in it for manual liquid dispensing. With some embodiments of the present invention, the existing aperture may provide a passageway sufficient to permit extending the dispensing system 10 through the aperture by detaching the pumping means 12 from the fluid delivery assembly 14 at first connector 20. If needed, the existing aperture 5 may simply be made larger by the user to accommodate the size of the dispensing system fluid delivery assembly 14.

Figure 4:
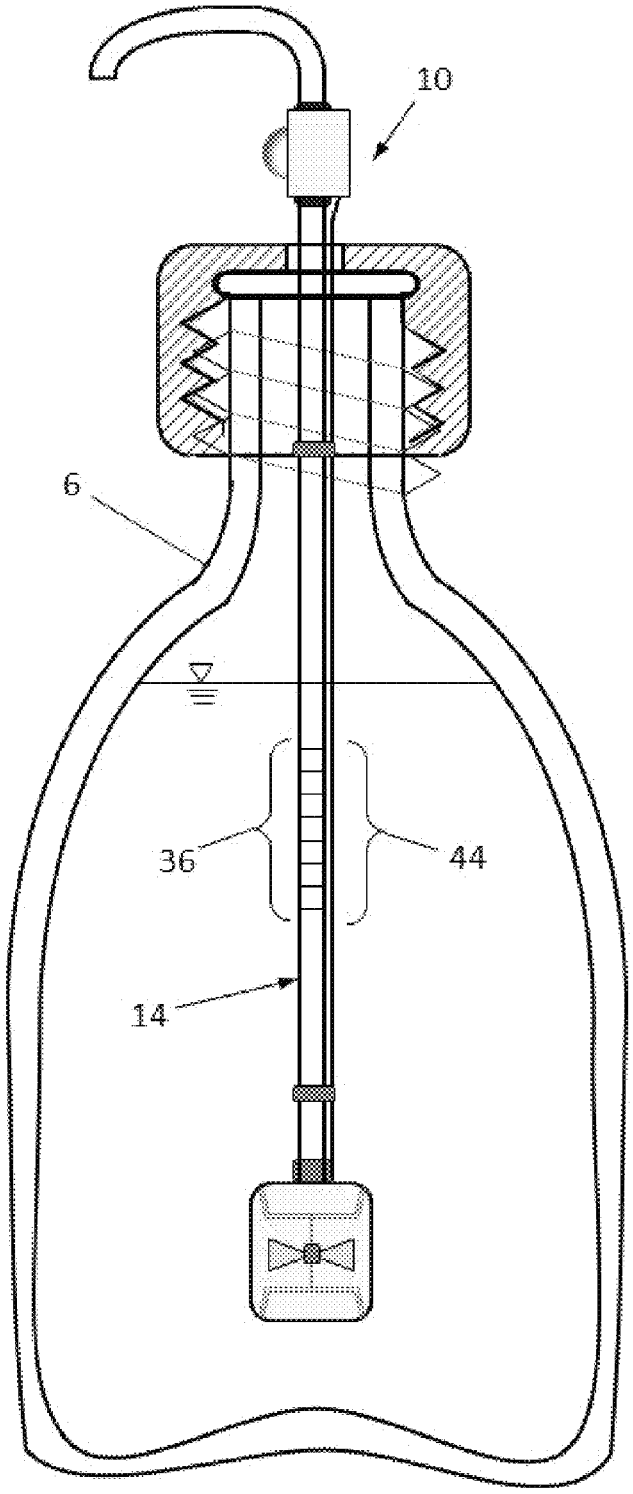
FIG. 4 shows a schematic elevational view of another application of the embodiment of FIG. 2.

In one important aspect of at least some embodiments of the present invention, the fluid delivery assembly 14 comprises a means 36 for extending and contracting the length of the fluid delivery assembly 14 relative to the position of the outlet 26 and the pumping means 20. Such extending and contracting means 36 may comprise a plurality of corrugations or an accordion-like configuration that permits manual extension and contraction of the fluid delivery assembly 14 as needed to fit liquid containers of different heights. In that regard, reference is made to FIGS. 3 and 4 where one example embodiment 10 of the automated dispensing system is shown in a short container 1 and a longer container 6, respectively. In application to a short container 1, the extension and contracting means 36 is shown in a somewhat contracted position, as shown in FIG. 3, while in application to the longer container 6, the extension and contracting means 36 is shown in a somewhat extended position, as shown in FIG. 4.

Referring back to FIG. 2, in some embodiments the controller assembly 16 comprises a detector 38 of one type of another for sensing the presence of a user desiring to have liquid dispensed from the container automatically. The detector 38 may be a motion detector or light detector or any other type of device for sensing the presence of the user at an appropriate time for liquid dispensing to be automated. The controller assembly 16 also preferably comprises a controller 40 in electrical communication with the detector 38 and the pumping means 12, which in some embodiments may comprise a cable 42 extending between the controller 40 and the pumping means 12. In such situations, the cable 42 may comprise a coiled portion 44 in one configuration or another to permit the tube 24 to be extended or contracted using the extension and contraction means 36 without detaching the cable 42 from the controller and/or the pumping means 12. Thus, when the tube 24 extends, the cable 42 extends, and vice versa when the tube is contracted. It should be understood that the electrical communication between the detector 38 and the controller 40 may be wireless or wired, as with the electrical communication between the controller 40 and the pumping means 12. The controller assembly 16 is preferably powered by an internal power source, such as a battery (not shown) that may be a rechargeable type or a replaceable type. Rechargeability of the battery may be made in one of numerous forms known to persons of ordinary skill in the art, including a small photovoltaic cell if so desired.

Figure 5A:
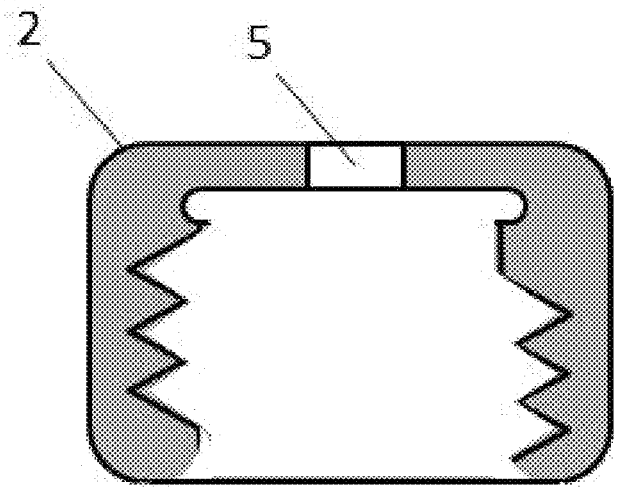
FIG. 5A shows a schematic elevational view of a container cap modified for use with one embodiment of the present invention.
Figure 5B:
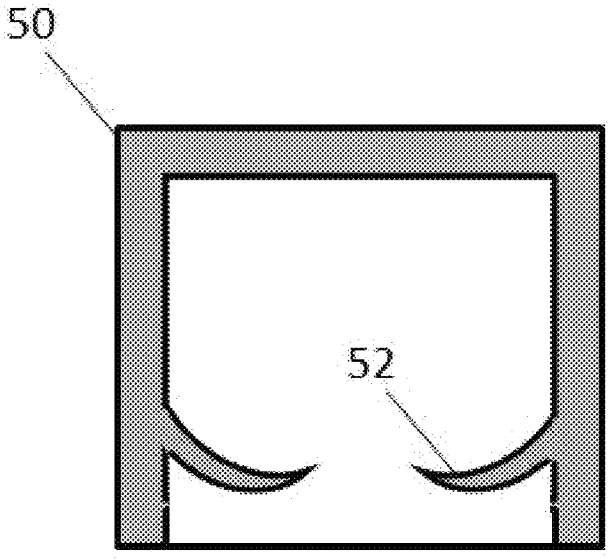
FIG. 5B shows a schematic elevational view of an alternative cap usable with embodiments of the present invention.
Figure 6:
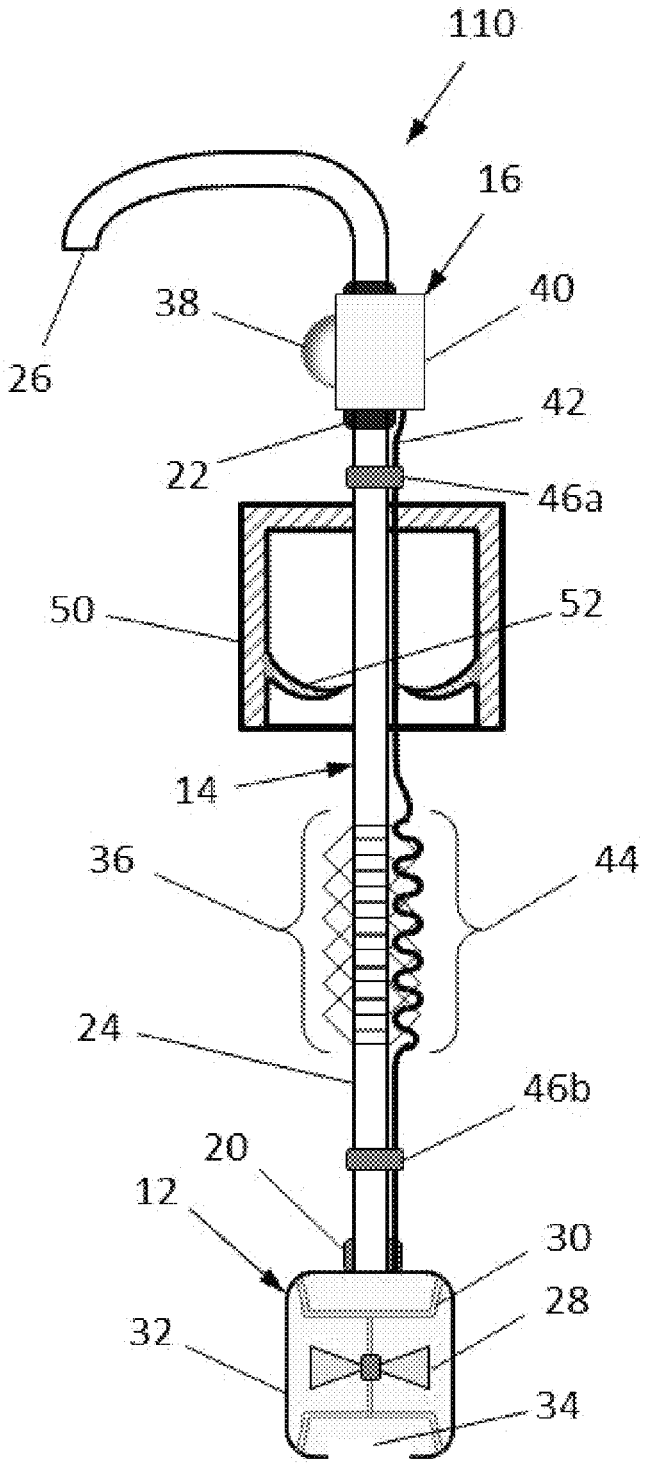
FIG. 6 shows a schematic elevational view of an embodiment of the present invention further comprising the alternative cap shown in FIG. 5B.
Figure 7:
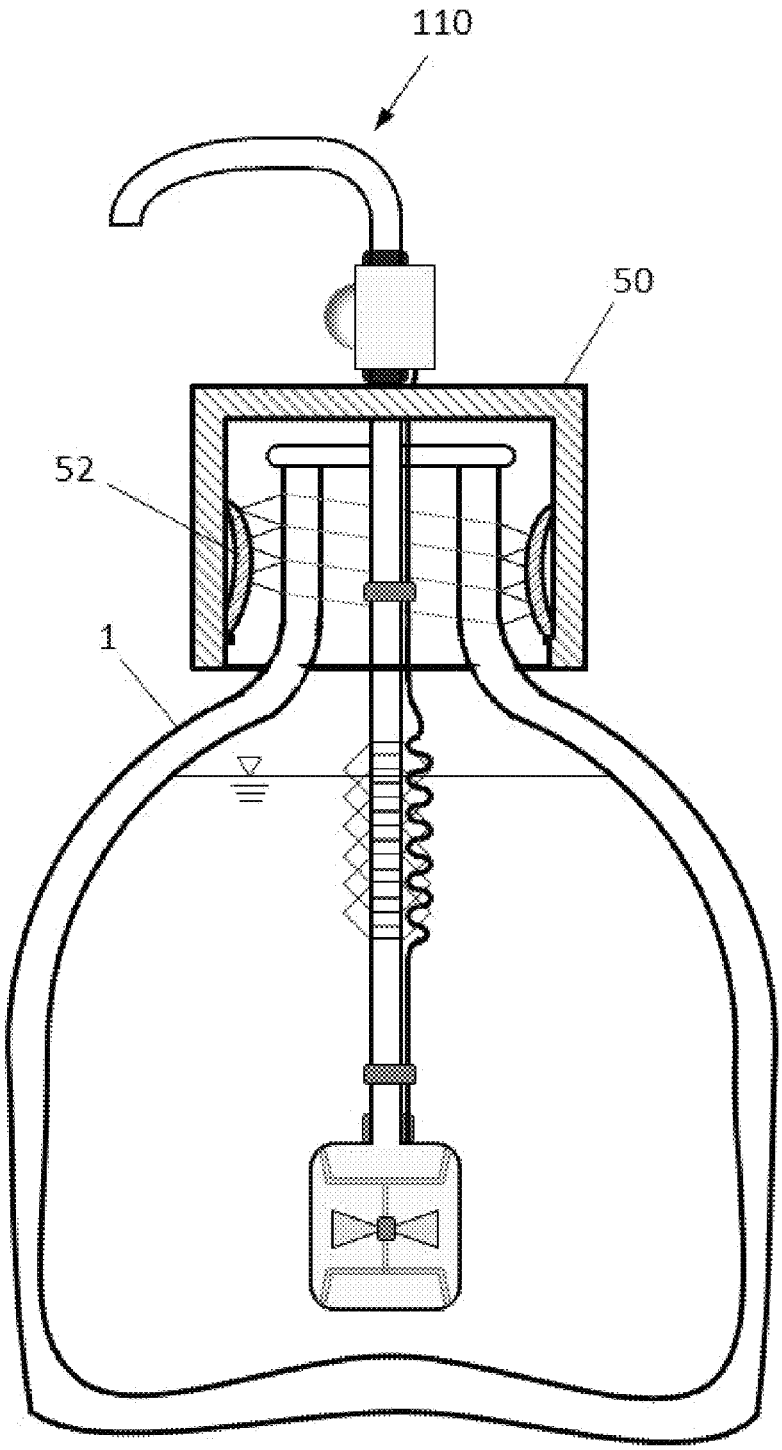
FIG. 7 shows a schematic elevational view of one application of the embodiment of FIG. 6.

Referring to FIGS. 5A and 5B, it should be appreciated that where an existing liquid container cap cannot be used to accommodate one or more embodiments of the present invention, it is contemplated that some embodiments may further comprise a universal cap 50 with an internal resilient seal 52 secured within the cap 50, as shown specifically in FIG. 5B and as applied to alternative system embodiment 110 of FIG. 6. Such a configuration, as may be appreciated from FIG. 7, permits use of embodiments of the present invention on bottles with different throat structures, threaded or not. In that regard, as the embodiment 110 of the dispensing system is applied to the container 1, the resilient seal 52 is pushed up against the exterior throat of the container to form a seal around the throat. With such an arrangement, a user need not worry about the existing cap and whether the dispensing system would mate with the existing cap, allowing for more universal use.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A universal automated hands-free liquid dispensing system configured for use with liquid dispensers each having a different neck and spout configuration and size, the system also being configured to be adaptable to dispensers of differing heights, the universal automated hands-free liquid dispensing system comprising:

an expandable tube configured to permit the flow of liquid from a liquid dispenser by way of pressurized flow, the tube comprising a fixed length portion and an expandable portion, the expandable portion being configured to permit manual extension or collapse of the expandable portion to accommodate dispensers of differing heights; the tube have a first end configured to engage a dispensing outlet and a second end configured to engage a means for pressuring the liquid in the liquid dispenser for purposes of directing the liquid through the tube from the dispenser to the dispensing outlet for delivery of the liquid to a user;

a means for pressurizing the liquid in the liquid dispenser and configured to reside within the liquid dispenser without adverse impact of the ambient liquid on operation f the pressurizing means, the means being configured to receive a signal from a sensor to initialize pressurizing of the liquid within the liquid dispenser, where such pressurizing means is configured to continuing pressurizing the liquid for dispensing through the tube and out of the dispensing outlet for as long as the signal continues to be sent; the pressurizing means configured to discontinue liquid pressurizing upon cessation of the signal; and a sensor for detecting the close proximity of a user to the dispensing outlet, the sensor configured to detect the user's proximity without the need of the user to touch any portion of the system thereby eliminating any contamination of the user attributable to germs or other infectious materials that may be present on any surfaces of the system and/or liquid dispenser, the sensor configured to be powered by a locally-mounted power supply and further configured to generate a signal to the pressurizing means to initiate pressurizing of the liquid and dispensing of the liquid to the user upon the detection of the user's proximity to the dispensing outlet.

2. The universal automated hands-free liquid dispensing system of claim 1, further comprising a dispenser cap configured to fit over dispensers of varied neck and spout configurations and dimensions; the dispenser cap comprising a top surface and side surfaces wherein the top surface comprises an opening configured to permit the passage therethrough of the fixed length portion of expandable tube in a secure manner.

3. The universal automated hands-free liquid dispensing system of claim 1, wherein the sensor comprises an infrared proximity sensor configured to detect the presence of a user within a certain distance from the sensor.

4. The universal automated hands-free liquid dispensing system of claim 1, wherein the sensor comprises a motion detector for detecting when a user is moving one or both hands within a certain distance from the sensor.

5. The universal automated hands-free liquid dispensing system of claim 1, wherein the pressurizing means comprises a DC motor configured to be housed within an enclosure to which the first end of the expandable tube may be sealably engaged.

6. The universal automated hands-free liquid dispensing system of claim 1, wherein the power supply may comprise one or more batteries housed within an enclosure and in electrical communication with the sensor to permit sensor operation.

7. The universal automated hands-free liquid dispensing system of claim 1, wherein the dispenser cap comprises an internal resilient member permitting sealable engagement with dispensing bottle necks and spouts of differing configurations and dimensions.

* * * * *